United States Patent [19]

Newbury

[11] Patent Number: 5,034,779

[45] Date of Patent: Jul. 23, 1991

[54] FIBRE TRAPS IN ELECTROSTATOGRAPHIC MACHINES

[75] Inventor: David M. Newbury, Welwyn Garden City, United Kingdom

[73] Assignee: Xerox Corporation, Stamford, Conn.

[21] Appl. No.: 621,674

[22] Filed: Dec. 3, 1990

[30] Foreign Application Priority Data

Feb. 20, 1990 [GB] United Kingdom ..... 9003748

[51] Int. Cl.[5] ..... G03G 21/00; G03G 15/06

[52] U.S. Cl. ..... 355/297; 118/652; 355/296

[58] Field of Search ..... 355/296, 297, 215, 298, 355/301; 15/256.5, 256.51; 118/652

[56] References Cited

U.S. PATENT DOCUMENTS

| | | | |
|---|---|---|---|
| 3,809,105 | 5/1974 | Horner | 355/296 X |
| 3,947,108 | 3/1976 | Thettu et al. | 355/297 |
| 3,999,511 | 12/1976 | Schwandt et al. | 355/256 X |
| 4,494,863 | 1/1985 | Laing | 355/302 |
| 4,819,026 | 4/1989 | Lange et al. | 15/256.51 X |
| 4,984,028 | 1/1991 | Tonomoto | 355/297 |

*Primary Examiner*—A. T. Grimley
*Assistant Examiner*—Nestor R. Ramirez

[57] ABSTRACT

An electrostatographic printer has a transfer zone at which a toner image is transferred from a moving photoreceptor to a copy sheet, and a cleaner blade for removing residual toner from the photoreceptor after image transfer. A trap is provided to collect paper fibres and other debris from the photoreceptor after the transfer zone and before reaching the blade. This debris would otherwise impair the ability of the blade to remove toner. The trap comprises a strip of compliant material such as a velour fabric which is suspended by its ends above the photoreceptor so as to hand under its own weight and to brush lightly against the photoreceptor. The fibre trap may be included in a removable xerographic unit incorporating the photoreceptor and other process means and adapted to be removable mounted in the main assembly of the copier.

15 Claims, 3 Drawing Sheets

FIBRE TRAPS IN ELECTROSTATOGRAPHIC MACHINES

CROSS REFERENCE TO COMMONLY ASSIGNED RELATED APPLICATIONS

Reference is made to copending application Ser. No. 07/621683 filed concurrently herewith in the name of Ion Brailsford et al. and entitled Electrostatographic Machine.

BACKGROUND OF THE INVENTION

This invention relates to an electrophotographic printing machine, particularly but not exclusively a xerographic copier, having a transfer zone at which a developed toner image is transferred from a moving image retaining member to a copy sheet, and means for cleaning residual toner material from the image retaining member after image transfer.

Conventionally, in the automatic xerographic process, a latent electrostatic image of an original to be reproduced is recorded upon an image retaining member and the image then made visible, or developed, by means of a finely divided particulate toner material. In reusable xerography, the developed toner image is generally transferred from the image retaining member to a copy sheet, such as paper or the like, and the image affixed thereto to form a permanent record of the original input scene information. Although a preponderance of the toner material comprising the developed image is transferred to the copy sheet, a small amount of residual toner is nevertheless invariably left behind on the image retaining member surface after the transfer operation. In order to restore the image retaining member to conditions suitable for reuse, the residual toner must be cleaned or removed from the image retaining member surface before a new imaging cycle is instituted.

The cleaning of the image retaining member may be accomplished in a number of different ways. One prevalent technique is to separate the residual toner from the image retaining member by means of an elastomeric blade element as disclosed in U.S. Pat. No. 3,660,863 to Gerbasi. In the blade cleaning process, the cutting edge of the blade is arranged to move between the residual toner particles and the surface of the image retaining member to chisel or cut the toner particles therefrom. Generally, the residual toner is collected in a chamber where it may either be stored for later disposal or recirculated for further use.

A problem may arise however because the copy sheets may have loose particles of debris on their surface. In particular, in the case of paper, paper fibres may be scrubbed or dislodged from the surface by the mechanism which feeds and advances them towards the transfer station, for example a friction retard system paper feeder frequently used in xerographic copiers. These paper fibres and other debris are then prone to collect on the surface of the image retaining member especially at the transfer zone. The debris is conveyed by the moving image retaining member towards the cleaner blade where particles of the debris may become lodged between the image retaining member and the cleaner blade thereby impairing the toner cleaning capability.

PRIOR ART

One way of overcoming this problem is to use a fibre trap between the image transfer zone and the cleaning means. Examples of such an arrangement are described in JP-A-59-49,575 and JP-A-59-49,576. In both cases, a napped fibre material strip or brush is used to contact the surface of photoreceptor drum. The strip or brush is secured to a rigid plate which may be either mounted in a fixed position next to the drum, or spring-urged towards it. Such arrangements are satisfactory for the relatively robust surface of a drum photoreceptor (usually a metallic drum with a coating of an inorganic, selenium-based, photoreceptor). A difficulty arises when it is desired to use such a fibre trap with a belt photoreceptor, because it is not desirable to press the fibre trap too firmly against the belt surface. Belt photoreceptors, which typically comprise an organic photoreceptor on a flexible plastic belt, are more susceptible to damage than the surface of a drum photoreceptor. One attempt to overcome this difficulty is to provide one or more fibre traps are provided in the form of a velour-type fabric secured to a resilient foam backing. The foam backing is attached by adhesive to the housing of the unit containing the photoreceptor belt. This arrangement gave rise to unexpected difficulties which arose from the chemical compositions of the photoreceptor and the foam backing material.

SUMMARY OF THE INVENTION

The present invention is intended to overcome these difficulties, and provides an electrostatographic printing machine having a transfer zone at which a developed toner image is transferred from a moving image retaining member to a copy sheet, and comprising means for cleaning residual toner material from the image retaining member after image transfer, and a fibre trap adjacent the image retaining member between the transfer zone and the cleaning means to trap paper fibres and other debris present on the surface of the image retaining member while permitting the residual toner to pass by, the fibre trap comprising a strip extending transversely to the direction of motion of the image retaining member and having a napped surface arranged to brush lightly against the surface of the image retaining member, characterized in that the strip is suspended by its ends above the image retaining member and is urged into engagement with the image retaining member only by its own weight.

The ability of the cleaning means to remove residual toner from the image retaining member is thus not impaired by paper fibres and other debris because they are trapped before reaching the cleaning means.

The trap preferably comprises a strip-like pad of compliant material such as fabric, e.g. a velour, having a napped surface arranged to brush lightly against the surface of the image retaining member.

Recently there has been a move in the xerographic art towards including the photoreceptor together with other process means such as a charge corotron, a development device, a transfer corotron and a cleaning device in a process unit in the form of a cssette. An example of such a cassette is described in U.S. Pat. No. 3,985,436. The use of a cassette of this kind enables the easy replacement of those parts of the xerographic machine which are most likely to deteriorate with use, especially the photoreceptor, but also the development and cleaning systems as well as the corotron wires.

Thus, in accordance with a further aspect of the present invention, there is provided a process unit adapted to be removably mounted in a main assembly of the electrostatographic copier in accordance with the first aspect of the invention, the unit comprising a housing wherein the imaging member and the fibre trap are present inside the housing.

Incorporating the debris trapping means inside the process unit has the advantage that it too will be changed for a fresh one each time the process is replaced.

BRIEF DESCRIPTION OF THE DRAWINGS

An embodiment of the invention will now be described, by way of example, with reference to the accompanying drawings, in which.

DETAILED DESCRIPTION OF THE INVENTION

Figure 1:
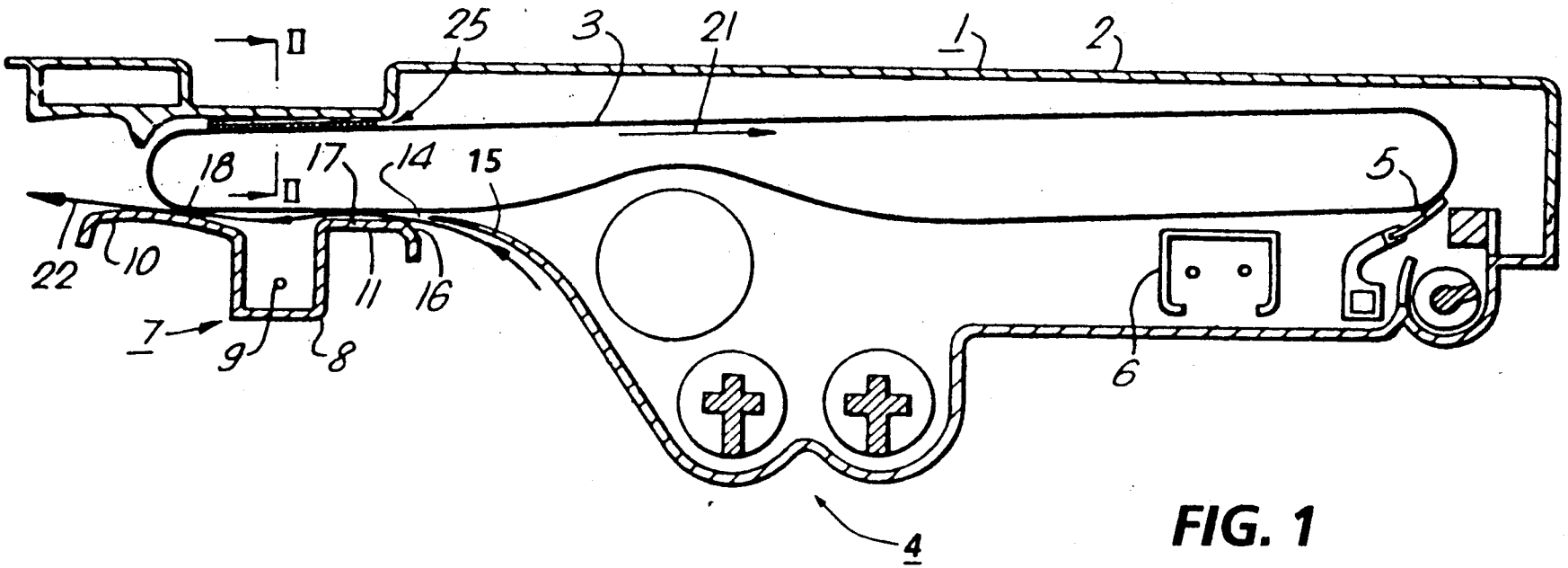
FIG. 1 is a schematic cross section of a process unit including a fibre trap in accordance with the invention.
Figure 2:
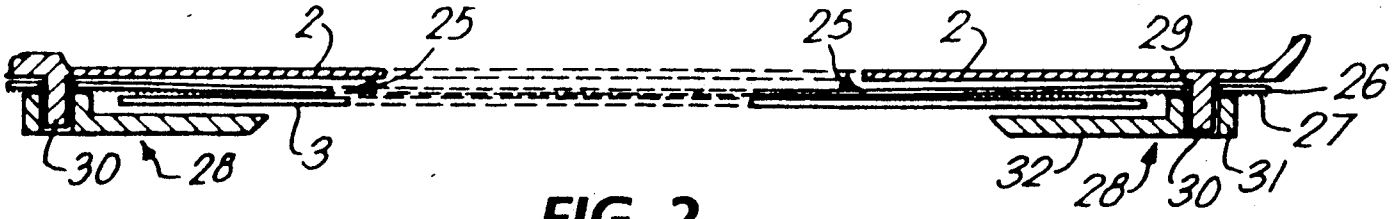
FIG. 2 is a cross section of the process unit taken on the line II—II in FIG. 1.
Figure 3:
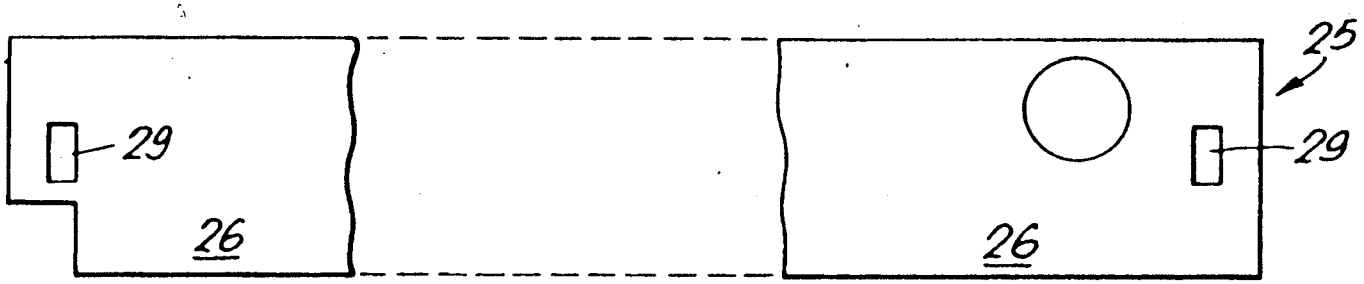
FIG. 3 is a plan view of the fibre trap.

The process unit or cassette 1 shown in FIG. 1 is designed to be removably mounted in the main assembly of a xerographic copier as described, for example, in the aforementioned U.S. patent and in U.S. Pat. No. 4,766,455 commonly assigned to the assignee of the present application to which reference is invited for further details. The cassette 1 comprises a housing 2 made for example, primarily of polystyrene, which encloses an imaging member in the form of a belt photoreceptor 3 in addition to various process means, in particular a development device 4, a cleaner blade 5, and a charge corotron 6. These processing means are not directly relevant to the subject matter of the present invention and so no further details are given here except to note that a retractable cleaner blade suitable for this application is the subject of U.S. Pat. No. 4,796,057 also commonly assigned to the assignee of the present invention. The belt photoreceptor is an endless flexible belt having a photosensitive surface. In the arrangement shown, when the cassette 1 is removed from the main assembly of the copier the belt is only loosely retained in the cassette but when the cassette is inserted into the main assembly of the copying machine, the photoreceptor belt is tensioned and supported in an operative position as shown. A cassette having this kind of loosely retained photoreceptor which is tensioned automatically on insertion into the main assembly of the copier forms the subject of the aforementioned U.S. Pat. No. 4,766,455. In operation, the photoreceptor 3 moves in an endless path in the direction of arrow 21.

A transfer charging device 7 is included in the cassette housing in the vicinity of the photoreceptor belt 3 at the area where a toner image is to be transferred from the belt to a copy sheet. The technique of actually transferring a toner image is well known to those skilled in the art and no further details need be given here. The transfer charging device is in the form of a corotron having an outer shield 8 which, as is conventional, is substantially U-shaped and made, for example, of stainless steel. A corona wire 9 extends the full length of the shield 8 and is spaced apart from the walls thereof in the usual manner.

At its upper end the shield has extended portions 10 and 11 on its left and right-hand sides respectively, as viewed in the drawing. These portions 10 and 11 act as guide members and define the path which a copy sheet follows as it passes through the transfer zone of the cassette for the purposes of having a toner image transferred thereto. An aperture 14 is present between the right-hand extension 11 of corotron shield 8 and the main part of the cassette housing to enable the copy sheet to enter the process unit. The aperture 14 is in the form of a slot extending substantially the full width of the cassette and is relatively narrow, for example, 2 mm wide. Thus the slot is sufficiently wide to permit a copy sheet to enter the cassette but narrow enough to provide appreciable protection for the photoreceptor from damage, contamination, and light exposure, thus prolonging the useful life of the photoreceptor.

The path which a copy sheet follows as it passes through the cassette for image transfer purposes is denoted by arrow 22 in FIG. 1. The external wall portion 15 of the main part of the cassette housing is shaped so as to deflect and guide the approaching copy sheets towards the aperture 14. Furthermore, the extreme right-hand side of the extended portion 11 of corotron shield 8 has a downturned lip 16 inclined obtusely relative to the adjacent plateau portion 17. The downturned lip 16 thus also acts to guide approaching copy sheets towards the aperture 14.

As the copy sheet enters the cassette it follows the path defined between the photoreceptor belt 3 and the plateau portion 17 of the corotron shield extension 11 which thus acts as a paper guide.

The belt photoreceptor 3 moves in the direction of arrow 21 and as it does so any paper fibres which have gathered on the surface thereof during image transfer are collected on the upstream side of trap 25 to prevent them being conveyed to the cleaner blade 5.

The trap 25 comprises a generally rectangular strip which extends transversely to the direction of motion of belt photoreceptor 3 and which is suspended from the top of housing 2 by retaining members 28. A layer of velour 27 is secured to the surface of a flexible plastics strip 26 adjacent the photoreceptor 3. Velour has a characteristically soft pile which is arranged to brush lightly against the surface of the photorecptor 3 and thus act as a fibre trap while permitting toner to pass by so that it can subsequently be removed from the photoreceptor 3 by the cleaner blade 5. The fibre trap 25 extends beyond the full width of the belt photoreceptor 3, and hangs under its own weight in contact with the top surface of the photoreceptor 3. The trap 25 comprises a rectangular strip with a hole 29 near each end, for location over a peg 30 extending down from the top of the housing 2. Retaining members 28 are a friction or snap fit over the pegs 30, and each has a collar part 31 for engagement over a peg 30, and a horizontally extending portion 32 which extends inwardly of the housing and beneath the top run of the edges of the belt photoreceptor 3. As an alternative to the flexible strip described for trap 25, a rigid strip may be used, the ends of which are slideable up and down vertical supports, so that the trap can rest under its own weight on the photoreceptor surface. The fibre trap of the invention is highly effective in removing fibres from the photoreceptor without causing damage to its surface, and without any other adverse side-effects.

Figure 4:
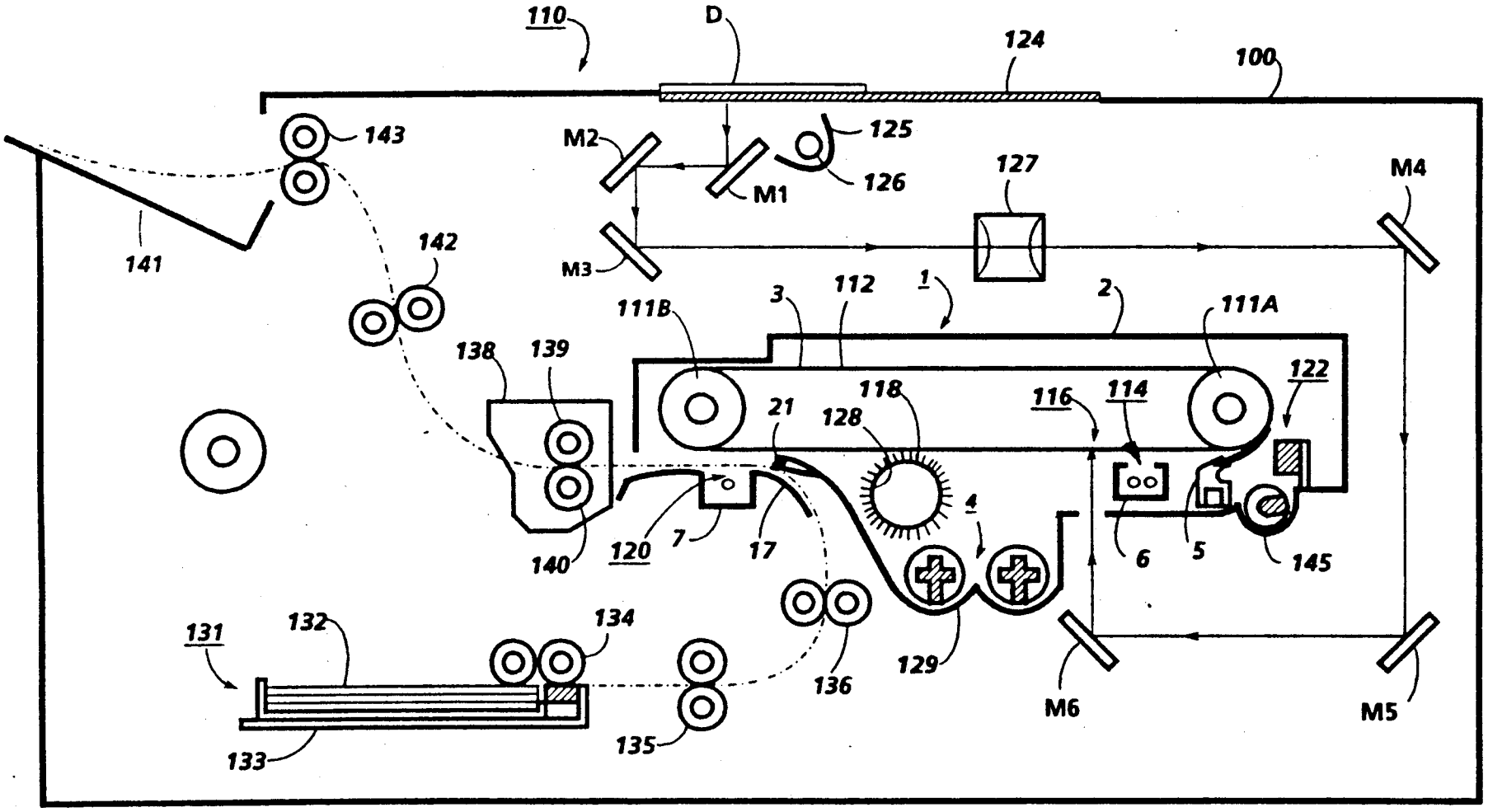
FIG. 4 is a schematic view in cross section of a reproducing machine having a cassette according to the invention.

Referring now to FIG. 4, there is shown schematically a xerogrpahic printing machine 110 having the removable process unit 1 of the present invention in its operational position in the main assembly 100. The machine includes an endless flexible photoreceptor belt 3 mounted for rotation in the clockwise direction as shown about support rollers 111*a* and 111*b* to carry the photosensitive imaging surface 112 of the belt 3 sequentially through a series of xerographic processing stations, namely a charging station 114, an imaging station 116, a development station 118, a transfer station 120, and a cleaning station 122.

The charging station 114 comprises a corotron 6 which deposits a uniform electrostatic charge on the photoreceptor belt 3. The photoreceptor belt 3, the charge corotron 6, the developer device 4, the transfer corotron 7, and the blade cleaner 5 may all be incorporated in a process cassette 1 adapted to be removably mounted in the main assembly 100 of the xerographic copier as described in U.S. Pat. No. 4,766,455.

An original document D to be reproduced is positioned on a platen 124 and is illuminated in known manner a narrow strip at a time by a light source comprising a tungsten halogen lamp 126. Light from the lamp is concentrated by an elliptical reflector 125 to case a narrow strip of light on the side of the original document D facing the platen 124. Document D thus exposed is imaged on the photoreceptor 1 via system of mirrors M1 to M6 and a focusing lens 127. The optical image selectively discharges the photoreceptor in image configuration, whereby an electrostatic latent image of the original document is laid down on the belt surface at imaging station 116. In order to copy the whole original document the lamp 126, the reflector 125, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 127 along its optical axis closer to the original document i.e. closer to mirrors M2 and M3, for magnification greater than unity, and away from the mirrors M2 and M3 for reduction, i.e. magnification less than unity. When the lens 127 is moved, the length of the optical path between the lens and the photoreceptor, i.e. the image distance, is also varied by moving mirrors M4 and M5 in unison to ensure that the image is properly focused on the photoreceptor 1. For this purpose mirros M4 and M5 are suitably mounted on a further carriage (not shown).

At the development station 118, a magnetic brush developer device with a developer roll 128 develops the electrostatic latent image into visible form. Here, toner is dispensed from a hopper (not shown) into developer housing 129 which contains a two-component developer mixture comprising a magnetically attractable carrier and the toner, which is deposited on the charged area of belt 3 a developer roll 128.

The developed image is transferred at transfer station 120 from the belt to a sheet of copy paper according to the practice of the present invention. The copy paper is delivered into contact with the belt in synchronous relation to the image from a paper supply system 131 in which a stack of paper copy sheets 132 is stored on a tray 133. The top sheet of the stack in the tray is brought, as required, into feeding engagement with a top sheet separator/feeder 134. Sheet feeder 134 feeds the top copy sheet of the stack towards the photoreceptor around a 180° path via two sets of nip roll pairs 135 and 136. The path followed by the copy sheets through an aperture in the cassette is denoted by a broken line. At the transfer station 120 transfer corotron 7 provides the electric field to assist in the transfer of the toner particles thereto.

The copy sheet bearing the developed image is then stripped from the belt 3 and subsequently conveyed to a fusing station 138 which comprises a heated roll fuser 139 to which release oil may be applied in known manner. The image is fixed to the copy sheet by the heat and pressure in the nip between the two rolls 139 and 140 of the fuser. The final copy is fed by the fuser rolls into catch tray 141 via two further nip roll pairs 142 and 143.

After transfer of the developed image from the belt some toner particles usually remain on the surface of the belt, and these are removed at the cleaning station 122 by a cleaner blade 5 which scrapes residual toner from the belt. The toner particles thus removed fall into a receptacle 145 below. Also, any electrostatic charges remaining on the belt are discharged by exposure to an erase lamp 146 which provides an even distribution of light across the photoreceptor surface. The photoreceptor is then ready to be charged again by the charging corotron 6 as the first step in the next copy cycle.

The patents and applications referred to herein are hereby specifically and totally incorporated herein by reference.

From the foregoing it will be evident that various modifications may be made within the scope of the present invention. While the invention has been illustrated with respect to copying apparatus it will be understood that it may be used in printer apparatus where a light beam such as a laser beam may be used to selectively discharge portions of the photoconductor. All such modifications and embodiments as may readily occur to the artisan are intended to be within the scope of the appended claims.

I claim:

1. An electrostatographic printing machine having a transfer zone at which a developed toner image is transferred from a moving image retaining member to a copy sheet, and comprising means for cleaning residual toner material from the image retaining member after image transfer, and a fibre trap adjacent the image retaining member between the transfer zone and the cleaning means to trap paper fibres and other debris present on the surface of the image retaining member while permitting the residual toner to pass by, the fibre trap comprising a strip extending transversely to the direction of motion of the image retaining member and having a napped surface arranged to brush lightly against the surface of the image retaining member, the strip being suspended by its ends above the image retaining member and urged into engagement with the image retaining member only by its own weight.

2. An electrostatographic printing machine as claimed in claim 1, wherein the strip is of a flexible material.

3. An electrostatographic printing machine as claimed in claim 1, wherein the strip comprises a velour fabric.

4. An electrostatographic printing machine as claimed in claim 1 wherein the image retaining member is a flexible photoreceptor belt.

5. An electrostatographic printing machine as claimed in claim 2 wherein the strip comprises a velour fabric.

6. An electrostatographic printing machine as claimed in claim 2 wherein the image retaining member is a flexible photoreceptor belt.

7. An electrostatographic printing machine as claimed in claim 3 wherein the image retaining member is a flexible photoreceptor belt.

8. A process unit adapted to be removably mounted in a main assembly of an electrostatographic printing machine comprising a housing means for cleaning residual toner material from the image retaining member after image transfer, and a fibre trap adjacent the image retaining member between the transfer zone and the cleaning means to trap paper fibres and other debris present on the surface of the image retaining member while permitting the residual toner to pass by, the fibre trap comprising a strip extending transversely to the direction of motion of the image retaining member and having a napped surface arranged to brush lightly against the surface of the image retaining member, the strip being suspended by its ends above the image retaining member and urged into engagement with the image retaining member only by its own weight.

9. A process unit as claimed in claim 8, wherein the strip is of a flexible material.

10. A process unit as claimed in claim 8, wherein the strip comprises a velour fabric.

11. A process unit as claimed in claim 8 wherein the image retaining member is a flexible photoreceptor belt.

12. A process unit as claimed in claim 8, wherein the fabric strip is suspended from an internal wall of the unit housing.

13. A process unit as claimed in claim 9 wherein the strip comprises a velour fabric.

14. A process unit as claimed in claim 9 wherein the image retaining member is a flexible photoreceptor belt.

15. A process unit as claimed in claim 10 wherein the image retaining member is a flexible photoreceptor belt.

* * * * *